United States Patent [19]

Booth

[11] 4,289,556

[45] Sep. 15, 1981

[54] METHOD AND APPARATUS FOR SPLICING FOLDED PAPER

[75] Inventor: Barclay Booth, Potomac, Md.

[73] Assignee: Paper, Inc., Gaithersburg, Md.

[21] Appl. No.: 63,697

[22] Filed: Aug. 6, 1979

[51] Int. Cl.[3] ..... B65H 19/00

[52] U.S. Cl. ..... 156/157; 156/252; 156/506; 156/513

[58] Field of Search ..... 156/157, 159, 505, 506, 156/513, 252

[56] References Cited

U.S. PATENT DOCUMENTS

| | | | |
|---|---|---|---|
| 1,038,874 | 9/1912 | Goodsir | 156/304 |
| 1,535,129 | 4/1925 | Monaceli | 156/505 |
| 2,827,104 | 3/1958 | Rives | 156/505 |
| 2,899,200 | 8/1959 | Alles | 156/505 |
| 3,547,739 | 12/1970 | Beute | 156/504 |
| 3,634,172 | 1/1972 | Fujii | 156/506 |
| 3,746,599 | 7/1973 | Peeters | 156/505 |
| 3,776,795 | 12/1973 | Steveson | 156/505 |
| 3,880,699 | 4/1975 | Nishimoto | 156/505 |

*Primary Examiner*—David A. Simmons
*Attorney, Agent, or Firm*—Fleit & Jacobson

[57] ABSTRACT

A device and method for interconnecting sections of fan-folded sheets to form a composite stack of a predetermined size. A base having an upper planer surface is provided for supporting a trailing transverse edge of the last sheet of a first section in abutting edge to edge relationship with the leading transverse edge of the first sheet of a succeeding section. Guide pins are located on the upper surface to assist in the positioning of the sheets. Splicing tape containing a centrally located row of longitudinally-extending perforations is then manually or automatically applied to regions of the sheets adjoining the abutting edges, with the perforations centrally located in a region between the abutting edges. One embodiment of the device of the present invention provides a mechanism for perforating the tape before it is applied to the adjoining edges. The invention also provides a mechanism for subjecting the individual sheets of a composite stack to a predetermined tension force and a mechanism for applying or printing identifying indicia to one side of the sheets forming the stack.

9 Claims, 8 Drawing Figures

FIG. 2
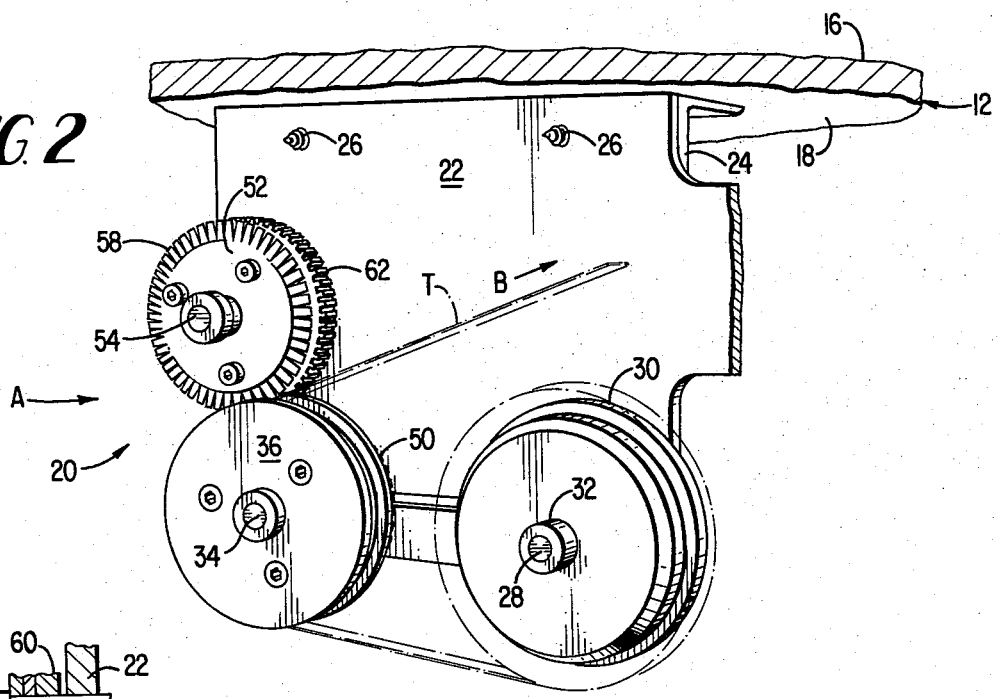
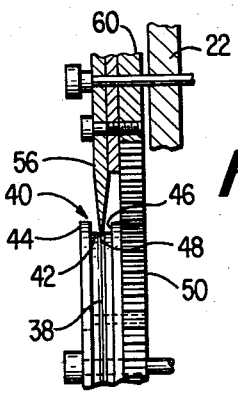
FIG. 3
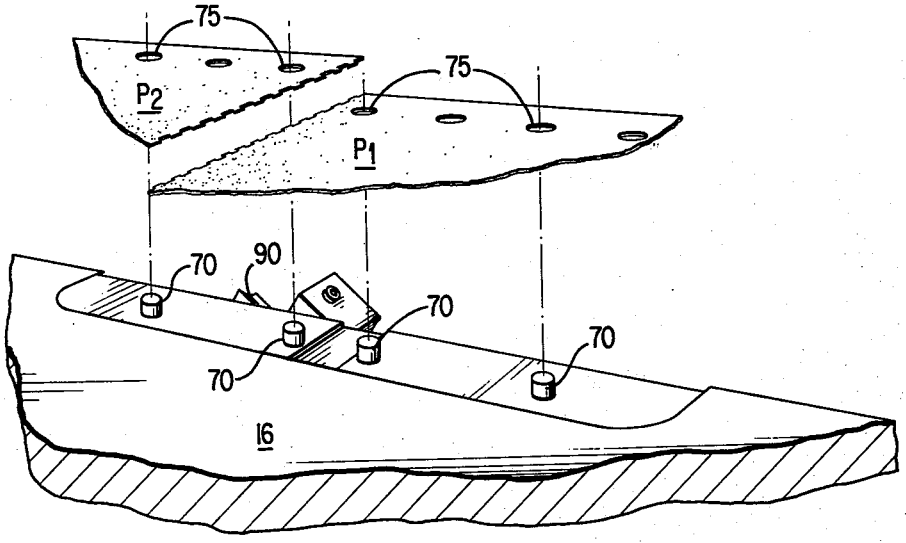
FIG. 4

METHOD AND APPARATUS FOR SPLICING FOLDED PAPER

BACKGROUND OF THE INVENTION

1. Field of the Invention

The present invention relates to machines of the type that splice two sheets of material together by applying a strip of adhesive tape to abutting edges of the material. More specifically, the present invention provides an apparatus and method for interconnecting a trailing transverse edge of a sheet of a first stack of fan-folded paper with a leading edge of a succeeding stack of fan-folded paper. By interconnecting sheets of individual stacks to each other, a stack is formed that is large enough to be supplied to a high speed printer, such as, a computer printer.

2. Description of the Prior Art

Apparatus and machines of the general type provided by the present invention are old. For instance, U.S. Pat. No. 2,827,104 describes a forms splicing machine having a table on which edges of two sheets are held in edge-to-edge abutting relation. A carriage containing a supply of adhesive tape moves across the table parallel with the abutting edges to apply tape in overlapping relation to abutting edge portions of the sheets. A knife is mounted on the carriage for cutting the tape.

Another type of previously known machine is described in U.S. Pat. No. 3,776,795. This patent describes an apparatus for joining ends of multi-layer printing forms to each other so as to provide a continuous supply of printing media to high speed printing machines. The end of one strip of multi-layer forms is positioned with the front edge of the next strip in aligned abutting relation. Then, a strip of adhesive material is applied across an outer sheet or layer of each strip. Subsequently, one or both forms are partially perforated leaving a partially folded overtab which holds the under layers in aligned relation to the outer sheet.

A problem with both of the aforementioned machines is that it is extremely difficult to subsequently separate the tape-joined sheets from each other.

Another problem with previously known machines is that no provision is made for verifying that the sheets of the individual joined stacks are, in fact, joined to each other.

SUMMARY OF THE INVENTION

Accordingly, the present invention provides both an improved apparatus and an improved method for joining ends of individual stacks of fan-folded paper or forms to form larger stacks suitable for feeding high speed printers.

Preferably, the stacks interconnected by the apparatus and method of the present invention are stacks of previously used computer printing paper. By interconnecting these stacks to each other, a sufficiently large stack is formed to feed a computer printer.

In one embodiment of the present invention, the sheets of the stacks, after the stacks have been interconnected are subjected to tension to ensure that all of the individual sheets are connected to each other. Also, the sides of the sheets containing previously printed information are marked to facilitate identification of the most recently printed material.

One embodiment of the present invention utilizes a support member or base that has a horizontally-extending surface for supporting sheets to be connected to each other. Parallel rows of alignment or locating pins are provided on the base to hold transverse edges of sheets to be connected in aligned abutting relation. After the sheets have been so positioned, a strip of splicing or adhesive tape is applied to and overlaps the abutting edge portions. The tape includes a longitudinally-extending row of aligned perforations that is positioned in the region where the edges abut. Preferably, the apparatus includes a mechanism for perforating the tape before it is applied to the sheets. The base also includes longitudinally-extending tape guides to assist in proper positioning of the splicing tape. Further, a lever-actuated knife mechanism is provided to simultaneously cut the tape adjacent both longitudinal edges of the joined sheets.

The method of the present invention provides for positioning a trailing transverse edge of the last sheet of a first stack of fan-folded paper on a support member or base in abutting relationship with a leading transverse edge of the first sheet of a succeeding fan-folded stack of paper. After the transverse edges have been positioned in an aligned abutting relation, splicing tape for joining the edges to each other is perforated so that a longitudinally-extending area of weakness is formed in the center of the tape. The so-weakened tape is then applied in overlaping relation to the abutting edges, with the area of weakness positioned in the region between the abutting edges. Subsequently, the joined stacks of sheets are subjected to tension to ensure that the individual sheets are connected to each other, passed over a printing mechanism that applies an identifying indicia to the sheets, and stacked to form an interconnected stack having a predetermined size.

The invention, and its objects and advantages, will become more apparent in the detailed description of the preferred embodiments hereinafter presented.

BRIEF DESCRIPTION OF THE DRAWINGS

In the detailed description of the preferred embodiments of the invention hereinafter presented, reference is made to the accompanying drawings, in which:

FIG. 2 is a schematic partial bottom view of the apparatus of FIG. 1;

FIG. 3 is a schematic, partial view taken in the direction of arrow A of FIG. 2;

FIG. 4 is a schematic enlarged perspective view of a portion of the apparatus of FIG. 1;

DESCRIPTION OF THE PREFERRED EMBODIMENTS

Figure 5:
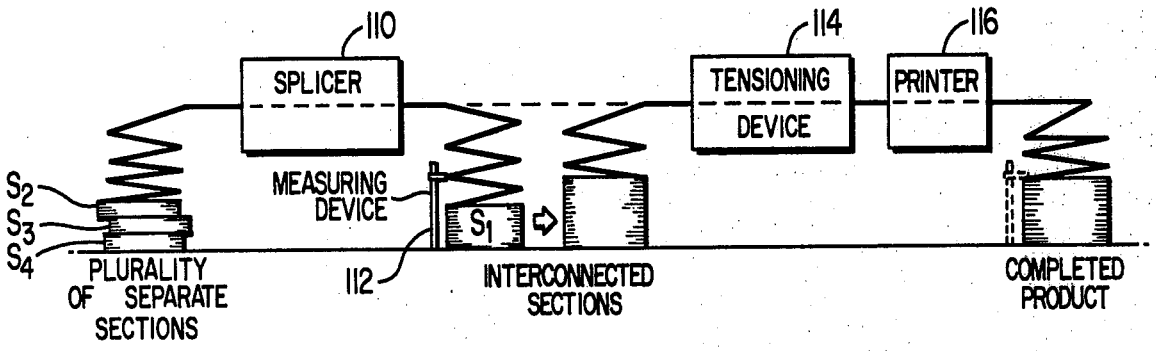
FIG. 5 is a schematic block diagram of a system for practicing the method of the present invention.

Because form and paper splicing machines and methods are well known, the present description will be directed in particular to elements forming part of, or cooperating more directly with, the present invention. Elements not specifically shown or described herein are understood to be selectable from those known in the art.

Referring now to the drawings, and to FIG. 1 in particular, one embodiment of the present invention is illustrated and will be described in connection with a paper or form connection apparatus or device, generally designated 10.

The device 10 has a support member or base, generally designated 12, supported by a plurality of legs 14 or other suitable support structure. The base 12, as illustrated in FIG. 2, has an upper horizontally-extending, generally planer surface 16 and a lower surface 18. A supply mechanism, generally designated 20, for splicing tape or other suitable adhesive material is connected to a mounting plate 22 extending below the lower surface 18. A mounting bracket 24 has a first portion connected to the lower surface of base 12 and a second portion connected by bolts 26 to the mounting plate. A first shaft 28 is provided on the plate for rotatably supporting a roll 30 of splicing tape T. A locking member 32 is provided to releasably hold roll 30 on the shaft. A second shaft 34 is provided for supporting a first composite roller 36. As illustrated in FIG. 3, the roller 36 has a first portion 38 defining a guide track 40 for the tape T. The guide track has a generally U-shaped profile with a base 42 having a width equal to or slightly greater than the width of the tape T. Flanges 44 of the first portion 38 form legs of the U-shape profile and serve to retain the tape T within the guide track 40. A groove 48, which is preferably generally V-shaped, is centrally located in the base 42 and extends circumferentially around the roller. A second portion or section 50 of the roller 36 forms a notched gear wheel that is coaxial with the first portion 38.

A second composite roller 52 is rotatably supported on the mounting plate 22 by a shaft 54. The roller 52 has a first perforating section 56 with a plurality of radially outwardly extending, spaced-apart blades 58. Preferably, the shape of the blades is complementary to the shape of the groove 48. Also, as illustrated in FIG. 2, the ends of adjacent blades are spaced from each other so that the blades form a row of longitudinally-extending perforations in the tape T. Further, the relationship between shafts 28 and 54 is such that outermost ends of the blades 58 extend into groove 48.

The roller 52, as illustrated in FIGS. 2 and 3, has a second section 60 that includes a notched gear wheel 62 that meshes with and is driven by the notched gear wheel 50 of roller 36.

Referring again to FIG. 1, a guide roller 64 is rotatably supported by a bracket 66 connected to base 12. The relationship between roller 64, roller 52, and roller 36 is such that when tape T is pulled in the direction of arrow B, roller 36 is rotatably driven by the tape. For instance, as illustrated in FIG. 2, tape T extends preferably around at least one half of the peripheral circumference of roller 36. Rotation of roller 36 results in a corresponding rotation of roller 52 because of the intermeshing of gears 50 and 62. Such rotation perforates tape T as it passes around roller 36.

Figure 1:
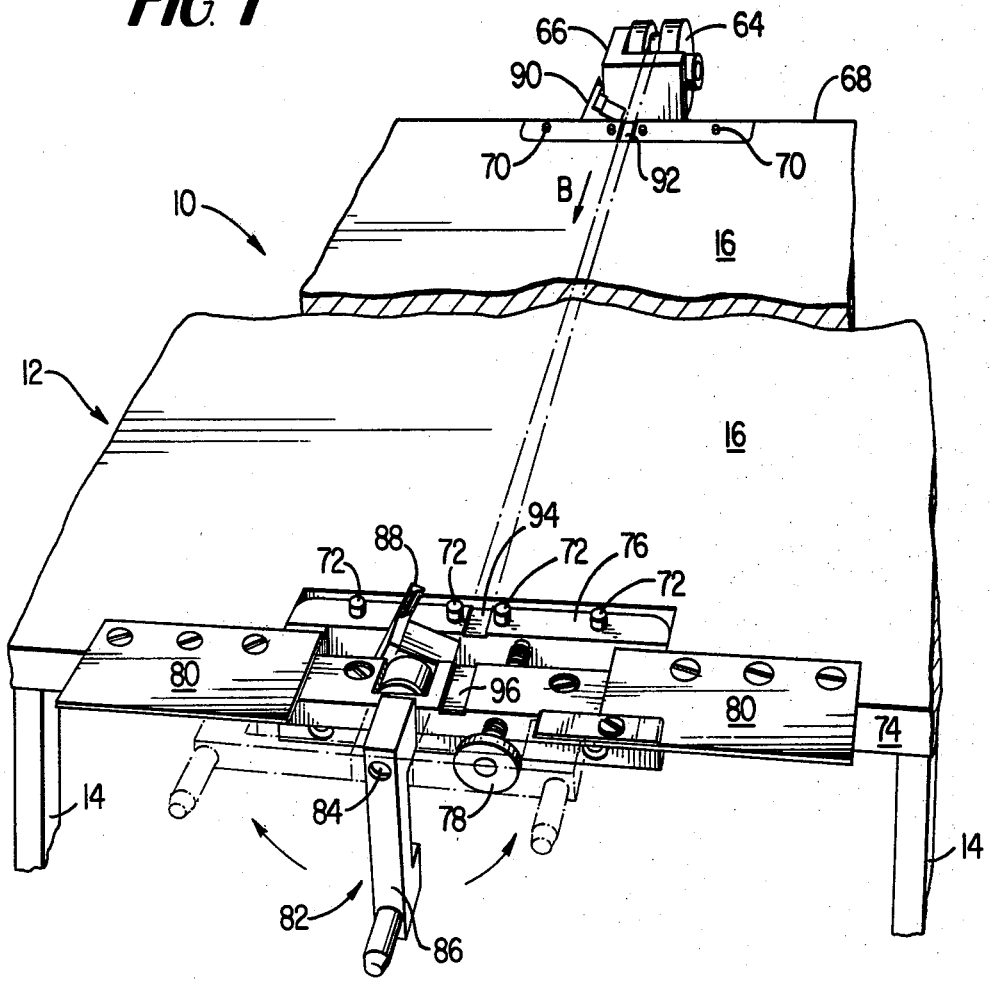
FIG. 1 is a schematic top perspective of one embodiment of an apparatus according to the present invention.

Base 12, as best shown in FIG. 1, has a rear edge 68 and a first plurality of alignment or locating pins 70 positioned parallel to and spaced from the edge. A second plurality of alignment pins 72 is positioned parallel to and spaced from a front edge 74 of base 12. The pins are positioned in such manner that they project above the plane of upper surface 16. As illustrated in FIG. 4, the pins 70 guide rows of marginal holes or aligning perforations 75 positioned along the longitudinal edges of sheets or forms $P_1$ and $P_2$ to be connected. In a similar manner, pins 72 engage with perforations (not illustrated) formed in the opposing longitudinal edges of sheets $P_1$ and $P_2$. Thus, the pins 70 and 72 provide a means for positioning transverse edges of the sheets on surface 16 in aligned abutting relation. When the sheets are so positioned, an abutting region is formed between their facing transverse edges.

Preferably, at least one of the groups of alignment pins, for instance, the pins 72, are mounted in movable brackets 76 so that the distance between the pins can be adjusted to compensate for variations in the widths of sheets being joined. For this purpose, the pins 72 are mounted in a movable bracket 76 that slides in an opening formed in base 12. A set screw 78 passes through a threaded bore in a holding bracket 80 to control movement and positioning of the bracket 76.

Base 12 also supports a tape cutting mechanism, generally designated 82. The mechanism 82 includes a shaft 84 that is supported for pivotal movement by base 12 and extends beyond the rows of pins 70 and 72. A lever or crank 86 is connected to one end of the shaft to pivot knife mechanisms 88 and 90 carried by the shaft between rest and cutting positions. Preferably, tape guides 92, 94, and 96 are provided in surface 16 to ensure proper positioning of tape T in overlapping relation to the abutting edge portions of the sheet. Preferably, the perforations formed in tape T by rotation of the blades 58 are positioned in the center of the abutting region formed between the facing edges of the sheets.

Referring now to FIG. 5, operation of a paper splicing system will be described. Since the splicer used with this system can be similar to the splicer illustrated in FIGS. 1 to 4, it has been identified with the reference numeral 110. The system also includes a measuring device 112 for determining the height of interconnected sections, a tensioning device 114 for subjecting the interconnected sections to tension, and, preferably, a printing device 116 for applying identifying indicia to one side of the interconnected sheets.

The measuring device 112, which is illustrated as a height measuring device, can also be a scale for measuring the weight of interconnected sections. A suitable tensioning device 114 is a commercially available decollator, a device normally used to separate individual sheets of multi-sheet forms from each other in a continuous manner. The printing device 116 can be either incorporated in or spaced from the tensioning device 114. Further, it can precede or follow the tensioning device. Preferably, the printing device includes a rotating roller that applies an ink stripe or repeating pattern to one side of the paper. If the paper being connected is previously used computer forms, the indicia would be applied to the previously printed side.

In operation, the measuring device 112 is adjusted to a predetermined level and a first section $S_1$ of interconnected forms is placed on the output side of the splicer 110. The trailing transverse edge of the last sheet of the stack, for instance sheet $P_1$ illustrated in FIG. 4, is placed on the upper surface of the splicer, with selected marginal holes of the sheet held by the pins 70 and 72. In a similar manner, the leading transverse edge of a sheet of a section $S_2$, for instance, sheet $P_2$ illustrated in FIG. 4, is positioned on the table with its transverse leading edge in edge-to-edge abutting relation with the transverse trailing edge of the sheet $P_1$. Tape is then pulled around roller 64, positioned above guides 92, 94, and 96, and then pressed onto portions of the sheets adjacent the abutting edges. As the tape passes from roll 30 around roller 36, it is perforated by the blades 58. The perforated portions of the tape are subsequently positioned in the middle of the abutting region between the facing transverse edges of the sheets. Lever 86 is then moved from its rest to its cut position to sever the ends of the tape.

After sections $S_1$ and $S_2$ have been interconnected, section $S_2$ is transferred to the output side of the splicer 110. The trailing transverse edge of the last sheet of section $S_2$ is then interconnected with the leading transverse edge of the first sheet of stack or section $S_3$ in the same manner that the sheets of sections $S_1$ and $S_2$ were interconnected to each other. Interconnection of sections continues in this manner until the height of the stack formed at the output of splicer 110 reaches the level set by measuring device 112. The stack of interconnected sections is then transferred to the input side of tensioning device 114, and the leading edge of the uppermost sheet is fed into the tensioning device. The tensioning device 114 and the printer or printing device 116 are then actuated so that each sheet of the interconnected sections is subjected to tension and printed with identifying indicia. The completed product is stacked on the output side of the printing device 116.

Preferably, the sheets of the interconnected sections are subjected to tension after a stack of sufficient height has been formed. It is possible, however, as shown by the dotted lines in FIG. 5, to connect the output of splicer 110 directly to the input of tensioning device 114. This is not a prefered mode, however, because tensioning devices presently available have larger than normal tension forces associated with starting and stopping of the devices.

Figure 6:
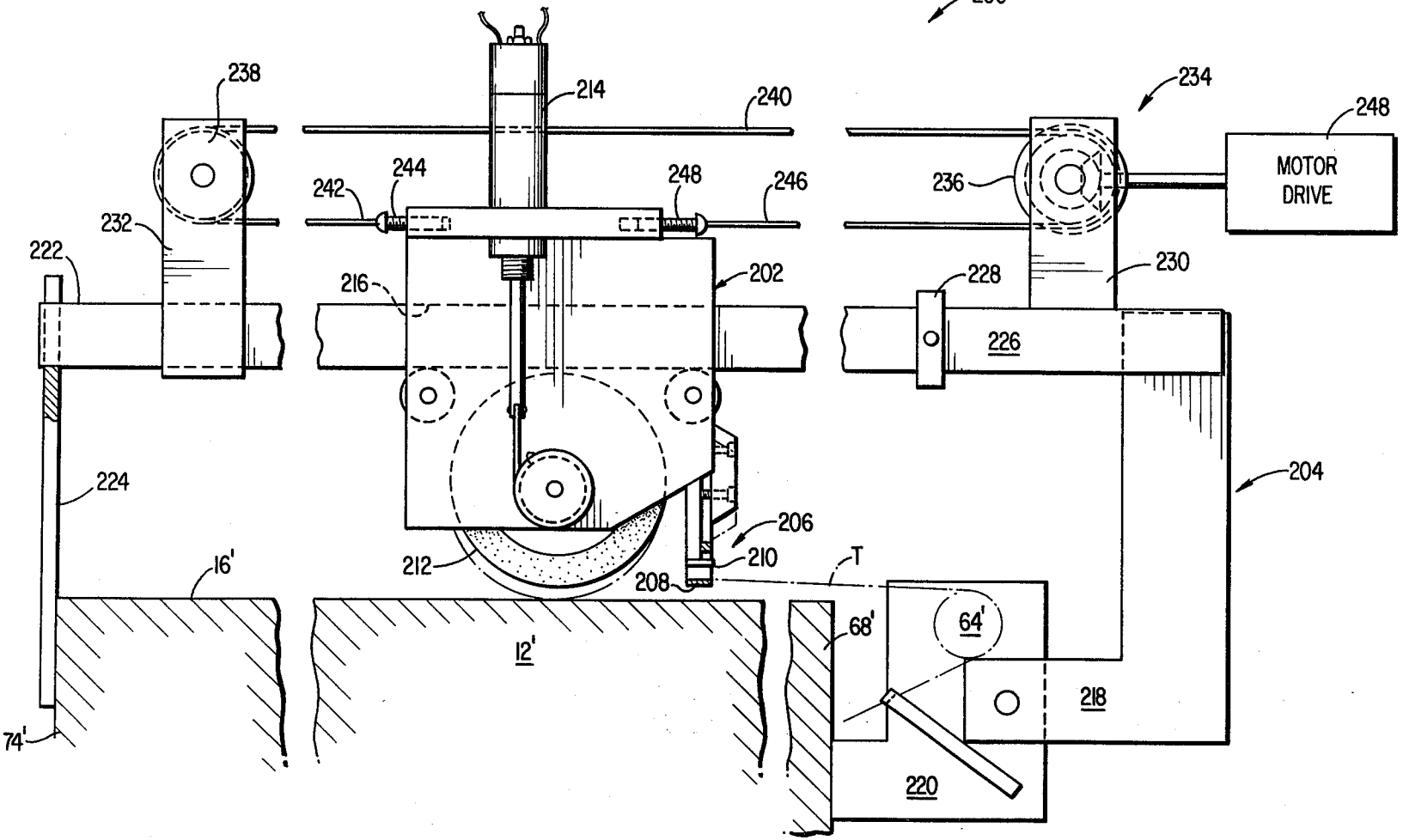
FIG. 6 is a schematic, partially cut-away, side view of one embodiment of a tape applying mechanism usable with the apparatus of FIG. 1.

Referring now to FIG. 6, a tape applying mechanism, generally designated 200, is illustrated. This mechanism is usable with a paper connection device of the type previously described in connection with FIGS. 1 to 5. Since the tape applying mechanism is usable with a device of the type previously described, the same reference numerals, with primes attached, have been used to identify components similar to those previously described.

The mechanism 200 includes a carriage, generally designated 202, that is supported by a support structure, generally designated 204, in such manner that the carriage is movable parallel to the upper surface 16' of the paper connection device. The carriage 202 has a gripping mechanism, generally designated 206, that includes a fixed member 208 and a movable member 210. The member 210 is movable towards the member 208, either manually or under the control of a suitable mechanism, such as a solenoid, to grip the end of tape T placed therebetween. Carriage 202 also rotatably supports a roller 212 that applies pressure to tape T after it has been applied to the sheets to be joined. Roller 212 is mounted in carriage 202 in such manner that it can be moved towards and away from surface 16' by a lifting mechanism 214. The mechanism 214 includes a solenoid-actuated device for moving the roller away from the upper surface 16' and suitable means, such as a spring, for urging the roller towards the surface 16'. Further, carriage 202 has an axially extending passageway formed therein to allow guiding of the carriage on the support structure 204.

Support structure 204 has a first end 218 pivotably connected to a member 220 extending from edge 68' of base 12'. The second or other end 222 of support structure 204 rests in a notch formed in a support member 224 connected to edge 74' of base 12'. Thus, support structure 204 can be pivoted away from surface 16' to faciliate positioning of sheets to be interconnected on the surface.

Support structure 204 includes a member 226 positioned parallel to and spaced from surface 16'. Member 226 supports carriage 202 in such manner that gripping mechanism 206 is centered for movement along the overlapping region formed between adjacent abutting edges of sheets to be interconnected. Preferably, at least one stop 228 is positioned on member 226 to limit movement of carriage 202.

Member 226 also supports brackets 230 and 232 that, in turn, support a transport mechanism for controlling horizontal movement of the carriage 202. The transport mechanism, which is generally designated 234, includes rollers 236 and 238 pivotably supported by the brackets 230 and 232, respectively. A chain or cable 240 passes around the rollers 236 and 238 and has a first end 242 connected to carriage 202 by a screw 244 threadedly received in a bore formed in an upper portion of one side of the carriage. Similarly, a second end 246 of the cable is connected by a screw 248 to an opposite face or side of carriage 202. The use of the screw connectors provides a mechanism for adjusting the tension in cable 240. Preferably, cable 240 is wrapped a plurality of times around roller 236 so that rotation of the roller by a motor drive 248 kinematically-linked to the roller controls back and forth movement of the cable.

The tape applying mechanism 200 operates as follows. First, motor drive 248 is actuated to position carriage 202 at a position closest to edge 68'. A leading edge of tape T is then inserted between the members or jaws 208 and 210, and member 210 is moved towards member 208 to releasably grasp the tape T. Motor 248 is then actuated to move carriage 202 from edge 68' towards edge 74'. During such movement, roller 212 is in a lowered position to flatten the abutting transverse edges of the sheets before the tape is applied thereto. Alternatively, the roller 212 can be in a raised position. After carriage 202 has been moved to a position closest to edge 74', movement of motor drive 248 is stopped. A tape cutting mechanism, such as previously discussed mechanism 82, is then actuated to sever the tape. Motor drive 248 is then actuated to return carriage 202 towards edge 68'. If desired, such movement can be accomplished while the carriage is pivoted away from the surface 16'. Alternatively, such movement can be accomplished with roller 212 in a lowered position to apply pressure to the previously applied tape. It will be appreciated that the positions of the gripping mechanism 206 and roller 212 can be interchanged so that pressure is applied to the tape immediately after it has been applied to the sheets. Also, a roll of pre-perforated tape can be used instead of the previously described tape supply mechanism.

Figure 7:
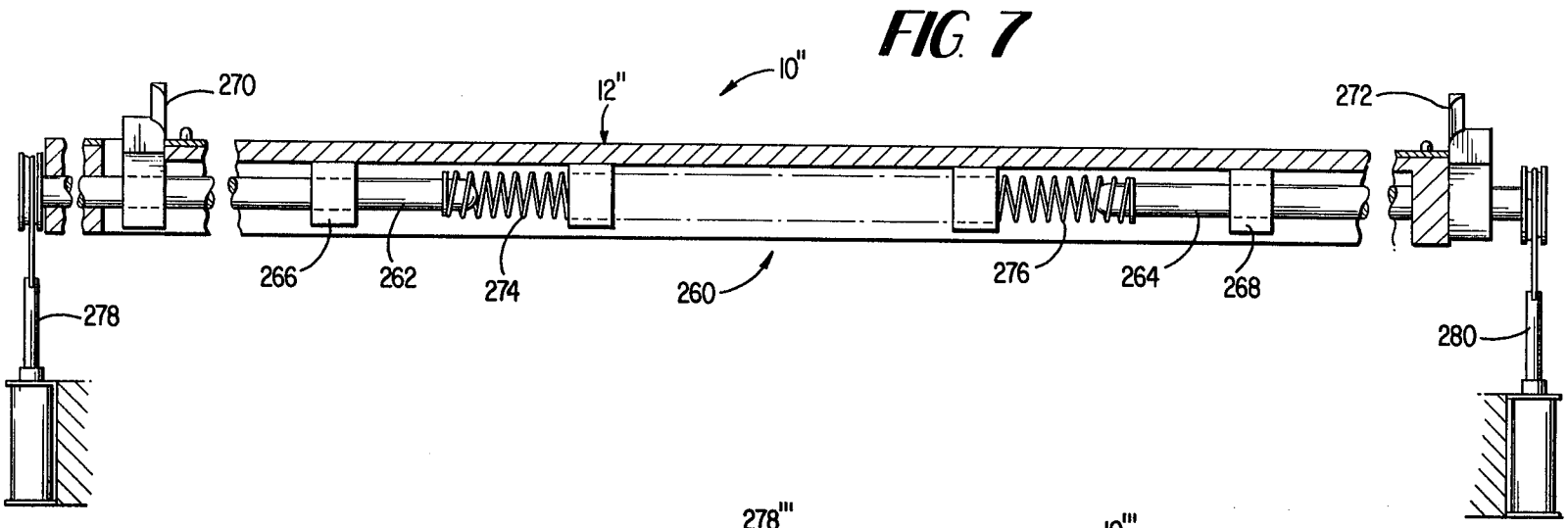
FIG. 7 is a schematic, partially cut-away, side view of one embodiment of a tape cutting mechanism usable with the apparatus of FIG. 1.

Referring now to FIG. 7, a tape cutting mechanism, generally designated 260, is illustrated. Since this mechanism is usable with a paper connection device of the type previously described, the same reference numerals, with double primes attached, have been used to identify components similar to those previously described.

The cutting mechanism 260 includes shafts 262 and 264 rotatably supported by brackets 266 and 268, respectively, connected to or forming part of base 12''. The shafts 262 and 264, intermediate their ends, support knife mechanisms 270 and 272, respectively. Springs 274 and 276 are provided for exerting both axial and rotational forces on the shafts 262 and 264, respectively. Actuation mechanisms 278 and 280, which are preferably solenoid-actuated, are provided at ends of the shafts for rotating the knife mechanisms between rest and cutting positions. After the actuation mechanisms rotate the knife mechanisms to perform a cutting operation, the springs 274 and 276 return the mechanisms to their rest position. Actuation of the mechanisms 278 and 280 can be accomplished either manually or automatically, for instance, by closing of a switch by carriage 202 during its horizontal movement.

Figure 8:
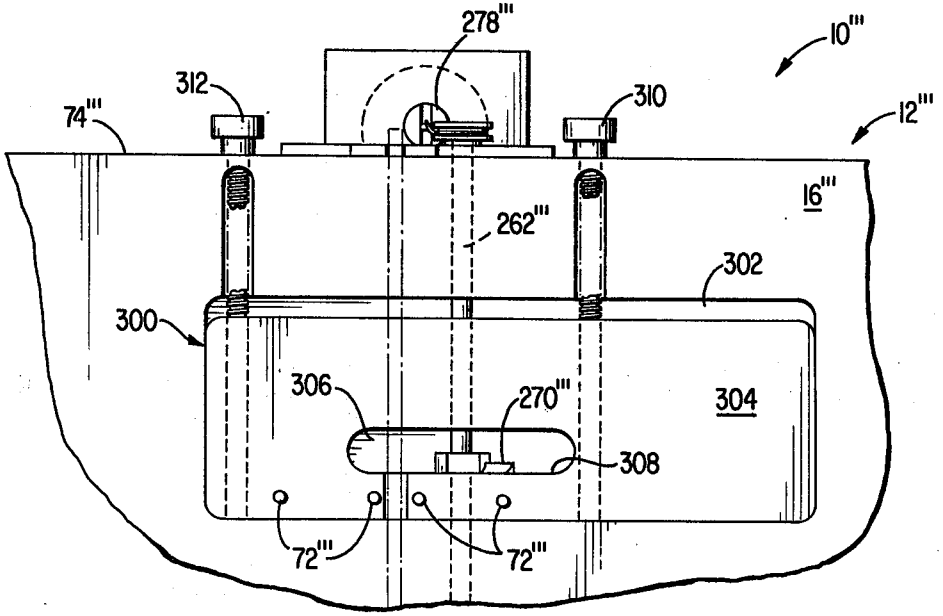
FIG. 8 is a schematic top view of one embodiment of a width adjusting mechanism usable with the apparatus of FIG. 1.

Referring now to FIG. 8, a width adjusting mechanism, which is generally designated 300, is illustrated. Since this mechanism is usable with a paper connection device of the type previously described, the same reference numerals, with triple primes attached, have been used to identify similar components.

The adjusting mechanism 300 is located in base 12''' spaced from edge 74'''. For this purpose, base 12''' has a generally rectangular-shaped opening 302 formed therein for accommodating a plate 304 having a plurality of alignment pins 72'''. Plate 304 contains an opening 306 to accommodate knife mechanism 270'''. Preferably, the shaft 262''' supporting the knife mechanism 270''' is spring biased in such manner that the knife mechanism 270''' is urged against an inner edge 308 of opening 306. Thus, the knife mechanism is able to move with plate 304 when the latter is moved by rotation of screws 310 and 312. These screws pass through bores formed in base 12''' and are received in threaded bores formed in plate 304.

Several modifications of the adjusting mechanism illustrated in FIG. 8 are possible. For instance, the plate 304 can be provided with one or more guide slots for receiving bolts connected to the base. The bolts cooperate with the slots to ensure precise back and forth movement of the guide plate. Also, side portions of the base adjacent the opening can be reinforced with one or more rigid plates to ensure that the size of the opening is not enlarged by frequent back and forth movement of the plate 304.

Previously, specific embodiments of the present invention have been described. It should be appreciated, however, that these embodiments have been described for the purposes of illustration only, without any intention of limiting the scope of the present invention. Rather, it is the intention that the present invention be limited only by the appended claims.

What is claimed is:

1. A method of joining together a plurality of sections of fan-folded interconnected single sheets to form a composite stack comprising:

positioning a trailing transverse edge of the last sheet of a first section of fan-folded interconnected single sheets in a predetermined position on a support surface;

positioning a leading transverse edge of the first sheet of a second section of fan-folded interconnected single sheets on the support surface in edge-to-edge abutting relation with the trailing transverse edge of the last sheet of the first section;

removing splicing tape from a tape reel and forming a row of longitudinally-extending perforations in the center of the tape as the tape is being removed;

centering the removed tape above the abutting edges of the sheets with the row of perforations centered above the abutting edges;

applying the tape to regions of the sheets adjacent the abutting edges in such manner that the tape interconnects the sheets with the row of perforations located between the abutting edges;

severing the applied tape adjacent the longitudinal edges of the interconnected sheets; and positioning the second section on top of the first section to form a composite stack.

2. A method according to claim 1, further comprising:

measuring the height of the composite stack formed by interconnecting the first and second sheets; and interconnecting additional sections to the composite stack to form a composite stack of predetermined height.

3. A method according to claim 2, further comprising:

subjecting sheets forming the composite stack to tension to ensure interconnection of the sheets to each other.

4. A method according to claim 2 or claim 3, further comprising:

applying identifying indicia to one side of the sheets forming the composite stack.

5. An apparatus for joining together a plurality of sections of fan-folded interconnected single sheets to form a composite stack comprising:

sheet supporting means having an upper support surface for supporting a trailing transverse edge of the last sheet of a first section of fan-folded interconnected single sheets in a predetermined position and for supporting a leading transverse edge of a second section of fan-folded interconnected single sheets in edge-to-edge abutting relation to the trailing transverse edge of the last sheet of the first section;

roll supporting means carried by a lower surface of said sheet supporting means for supporting a roll of a splicing tape so that the tape is removable from the roll and applied to portions of the sheets adjacent the abutting edges to thereby join the sections together;

means carried by said sheet supporting means for forming a row of longitudinally-extending perforations in the center of splicing tape during its removal from said roll supporting means; and means for severing splicing tape applied to the sheets and extending beyond longitudinal edges of the sheets.

6. An apparatus according to claim 5, wherein said sheet supporting means includes a horizontal support surface, and wherein said apparatus further comprises tape applying means for receiving splicing tape from said roll and for applying received tape to portions of the sheets adjacent the abutting edges with the row of perforations being positioned between the abutting edges, said tape applying means including a carriage for receiving tape to be applied, means for supporting the carriage for horizontal movement above said support surface, and means for horizontally moving the carriage.

7. An apparatus according to claim 5 or claim 6, further comprising means for subjecting the sheets of joined sections to a tension force to ensure interconnection of the sheets to each other.

8. An apparatus according to claim 7, further comprising means for applying identifying indicia to one surface of the sheets of joined sections.

9. An apparatus for joining together a plurality of sections of fan-folded interconnected single sheets containing printed information on one side thereof to form a composite stack comprising:

sheet supporting means having a horizontal support surface for supporting a trailing transverse edge of the last sheet of a first section of fan-folded interconnected single sheets containing printed information on one side thereof in a predetermined position and for supporting a leading transverse edge of the first sheet of a second section of fan-folded interconnected single sheets containing printed information on one side thereof in edge-to-edge abutting relation to the trailing transverse edge of the last sheet of the first section with the printed sides of the sheets having the same orientation;

means positioned underneath said support surface for supporting a roll of a splicing tape so that the tape is removable from the roll, perforated in a longitudinally-extending central region thereof, and applied to portions of the sheets adjacent the abutting edges to thereby join the sections together;

means for severing splicing tape applied to the sheets and extending beyond longitudinal edges of the sheets;

means for subjecting the sheets of joined sections to a tension force to ensure interconnection of the sheets to each other; and means for applying identifying indicia to the printed side of the sheets of joined sections.

* * * * *